US009051816B2

(12) United States Patent
Byzeev et al.

(10) Patent No.: US 9,051,816 B2
(45) Date of Patent: Jun. 9, 2015

(54) UCG CHANNEL

(75) Inventors: Victor Byzeev, Tashkent (UZ); Andrey Chernishov, Brisbane (AU)

(73) Assignee: Linc Energy Ltd, Brisbane, Queensland (AU)

( * ) Notice: Subject to any disclaimer, the term of this patent is extended or adjusted under 35 U.S.C. 154(b) by 0 days.

(21) Appl. No.: 14/362,356

(22) PCT Filed: Feb. 8, 2012

(86) PCT No.: PCT/AU2012/000117

§ 371 (c)(1), (2), (4) Date: Sep. 10, 2014

(87) PCT Pub. No.: WO2013/086557

PCT Pub. Date: Jun. 20, 2013

(65) Prior Publication Data

US 2015/0000895 A1 Jan. 1, 2015

(30) Foreign Application Priority Data

Dec. 15, 2011 (AU) ..... 2011905235

(51) Int. Cl.
*E21B 43/00* (2006.01)
*E21B 43/295* (2006.01)
*E21B 43/28* (2006.01)

(52) U.S. Cl.
CPC ..... *E21B 43/006* (2013.01); *E21B 43/295* (2013.01); *E21B 43/28* (2013.01)

(58) Field of Classification Search
CPC ..... E21B 43/295; E21B 43/28; E21B 43/006; E21B 43/24; E21B 43/168; E21C 45/00; E21C 45/06
USPC ..... 166/57, 58, 302; 175/206, 207; 137/205.5; 299/3, 4, 5, 6; 405/269; 261/78.2; 239/8, 337, 398
See application file for complete search history.

(56) References Cited

U.S. PATENT DOCUMENTS

| | | | | |
|---|---|---|---|---|
| 3,417,818 | A * | 12/1968 | Dyson | 166/262 |
| 3,580,862 | A | 5/1971 | Watson et al. | |
| 3,770,398 | A * | 11/1973 | Abraham et al. | 166/261 |
| 3,999,607 | A | 12/1976 | Pennington et al. | |
| 4,032,193 | A * | 6/1977 | Drinkard et al. | 299/4 |
| 4,132,448 | A * | 1/1979 | Davis | 299/5 |
| 7,093,655 | B2 | 8/2006 | Atkinson | |

FOREIGN PATENT DOCUMENTS

GB 2329407 A 3/1999

OTHER PUBLICATIONS

International Search Report and Written Opinion of the International Searching Authority, mailed May 25, 2012, for corresponding International Application No. PCT/AU2012/000117, 14 pages.

* cited by examiner

*Primary Examiner* — Nicole Coy
(74) *Attorney, Agent, or Firm* — Klarquist Sparkman, LLP

(57) ABSTRACT

A pressurized alkali dispersion supply system for use in permeabilizing a coal seam, and in particular for connecting together open zones in a coal seam using a (almost horizontal) linkage channel comprising a multitude of fine cracks. The system includes a source of alkali/alkali solution, a source of pressurized air, a supply pipe and a fogger for forming an alkali mist that is dispersed within the pressurized air. Cracks/fractures open up in the coal seam (ie. permeabilization) under the influence of the compressed air together with dissolution of humic acids by the alkali mist.

12 Claims, 3 Drawing Sheets

UCG CHANNEL

CROSS REFERENCE TO RELATED APPLICATIONS

This is the U.S. National Stage of International Application No. PCT/AU2012/000117, filed Feb. 8, 2012, which in turn claims the benefit of and priority to Australian Patent Application No. AU2011905235, filed Dec. 15, 2011.

TECHNICAL FIELD

This invention relates to a method of permeabilizing a coal seam. In particular, the invention concerns a method of connecting two open zones of a coal seam together with a linkage channel using pressurized alkali solution.

BACKGROUND ART

Underground coal gasification (UCG) is a process by which product gas is produced from a coal seam by combusting and gasifying the coal in situ in the presence of an oxidant. The product gas is typically referred to as synthesis gas or syngas and can be used as a feedstock for electricity or chemical production, for example.

Conversion of coal into product gas takes place in a well which typically comprises a channel of sorts extending through the coal seam. Such a channel can be formed by one or more bore holes drilled into the coal seam that are in fluid communication with one another or by non-drilling methods as described below. For UCG, the channel is also in fluid communication with an injection well and a production well.

A coal seam panel is typically referred to as a coal gasifier. Gasification occurs adjacent a combustion zone of the well/gasifier and the coal is partially oxidized to produce product gas of low or medium heating value. Hot product gas flows from the gasification zone and exits the ground from a well head of the production well. As coal is consumed or gasified, a gasifier cavity within the coal seam develops and grows in size.

Non-drilling methods for permeabilizing coal and connecting (linking) wells together by way of a linking channel such that they are in fluid communication with one another are known. Such methods utilize chemical, electrical, thermal or mechanical forces or combinations of these. Typically, coal of the coal seam is permeabilized outwardly from a base of a vertical or inclined well and a horizontal linking channel of sorts is formed to another well or other type of open zone in the coal seam (eg. a gasifier cavity).

One known method of creating a linking channel involves burning through the coal seam using only the natural permeability of the coal. Burning through of a channel can also be performed after artificially increasing the coal seam's permeability by heat treatment, hydraulic or pneumatic rupture.

A known method of increasing the permeability of a massif of mineral deposits is by hydraulic rupturing whereby liquid is injected under high pressure into the massif from the base of a well. However, a disadvantage of the method is that water injected into a UCG gasifier cavity may have a quenching effect.

Another known method of creating a horizontal linking channel between a well and an operational gasifier cavity involves operating a high-pressure water jet at a base of a vertical well. Although the jet (hydro monitor) may target and penetrate the coal seam quite effectively, again, a disadvantage of the method is that water injected into the gasifier cavity may have a quenching effect.

Yet another linkage method concerns the injection of high pressure air (20-40 atm) so as to further open natural cracks/fractures in the coal seam. This method involves injecting pressurised air into the coal seam from a vertical well. A disadvantage of this method, however, is that pressurized air tends to preferentially act on existing cracks in the coal seam rather than propagate new cracks. Hence, typically cracks will occur in no more than about 15% of the total volume in the coal seam and linkage may thus not be successful. Another disadvantage is that, due to low permeability (filtration) of coal (shale), it is difficult to create a channel. This leads to low efficiency of the method. An associated disadvantage is that further vertical wells may need to be installed, which increases operating costs. Yet another disadvantage is the high energy expenditure required for the injection of large quantities of air to achieve linkage.

SUMMARY OF INVENTION

The present inventors have now developed a method of permeabilizing a coal seam, particularly for connecting at least two open zones of a coal seam together with a linkage channel, utilizing pressurized alkali dispersion, which overcomes or minimizes a disadvantage mentioned above.

According to a first aspect of the present invention there is provided a method of permeabilizing a coal seam, said method comprising the step of injecting a pressurized alkali dispersion into the coal seam so as to permeabilize coal of the coal seam.

According to a second aspect of the present invention there is provided a method of permeabilizing a coal seam to connect at least two open zones of a coal seam together with a linkage channel, said method comprising the step of injecting a pressurized alkali dispersion into a first said open zone of the coal seam so as to permeabilize coal of the coal seam and form a linkage channel to at least a second said open zone.

According to a third aspect of the present invention there is provided a pressurized alkali dispersion supply system, said system comprising:

- a source of alkali;
- a source of pressurized fluid;
- a supply pipe having a fluid inlet connected to the source of pressurized fluid, an alkali inlet connected to the source of alkali, and an outlet connectable to a well for injecting the pressurized alkali dispersion into a coal seam; and
- a fogger associated with the alkali inlet for forming an alkali mist that can mix with pressurized fluid within the supply pipe to form a pressurized alkali dispersion.

According to a fourth aspect of the present invention there is provided a pressurized alkali dispersion supply system, said system comprising:

- a source of pressurized alkali dispersion; and
- a supply pipe having an inlet connected to the source of pressurized alkali dispersion and an outlet connectable to a well for injecting the pressurized alkali dispersion into a coal seam.

According to a fifth aspect of the present invention there is provided a pressurized alkali dispersion for permeabilizing a coal seam or connecting at least two open zones of a coal seam together with a linkage channel.

Preferably the pressurized alkali dispersion comprises alkali dispersed in a pressurized fluid which is preferably a gas (which may of course include a mixture of different gaseous components).

Any suitable type of alkali (from Group I of the periodic table) can be used. Particularly preferred types of alkali include sodium, potassium and lithium, or mixtures of two or more of these.

The alkali can be in any suitable form but is preferably in a liquid form, such as an aqueous solution of NaOH, KOH or LiOH (or mixtures thereof). Although any suitable concentration can be used—eg. approximately 5, 10, 15, 20, 25, 30, 35, 40, 45 or 50% weight by weight—between about 20% and 30% weight by weight of alkali hydroxide (eg. NaOH) is preferred.

The pressurized fluid can be any suitable type of fluid or fluids provided that it can mix with the alkali to form a dispersion and does not interfere with permeabilization of the coal seam, nor negatively affect gasification. Preferably the pressurized fluid is pressurized air although other gases (including mixtures of gaseous components) can be used. Preferably the fluid is supplied to the coal seam at a pressure of between about 10-30 atmospheres, although potentially pressures of about 5, 7.5, 10, 15, 20, 25, 30, 35 or 40 atmospheres could be used. The source of pressurized fluid is preferably an air compressor or a tank of compressed air.

The fogger can be of any suitable size, shape and construction, and it can produce alkali particles of any suitable size. Preferably the fogger (also known in the art as a mister or sprinkler) produces alkali solution particles having an average size anywhere between about 10 and 40 microns.

The fogger can spray an alkali solution mist at a controlled rate into the supply pipe such that it is at a ratio of approximately 80% volume/volume pressurized fluid to 20% volume/volume mist. However, the ratio will depend on the chemical and physical properties of the coal seam to be permeabilized. Other suitable ratios may be, for example, approximately 90% volume/volume pressurized fluid to 10% volume/volume mist, 70:30, 60:40 or 50:50.

The system can comprise an alkali tank containing the source of alkali and this tank can be of any suitable size, shape and construction. For example, the tank can have a capacity of 150 to 190 liters. The alkali inlet can extend to within the supply pipe from a bottom of the tank. A control valve of the system associated with the alkali inlet can control the flow rate of alkali solution here through. The tank can have a fluid inlet connected to the supply pipe for receiving compressed fluid so as to place the source of alkali under pressure as well as to ensure proper mixing the tank's contents. A control valve associated with the fluid inlet can regulate the flow of compressed fluid into the alkali tank.

The supply pipe can be of any suitable size, shape and construction. The supply pipe preferably has an inner diameter of about 150-300 mm (preferably about 160 mm), for example, and an outlet that can couple with a well head of the well. This coupling can be achieved in any suitable way. The supply pipe preferably feeds the well compressed alkali dispersion at a rate of about 2-10 $m^3$/min over the required time period—about 6, 12, 18, 24, 30, 36, 42, 48, 54, 60, 66, 72, 78, 84, 90, 96, 102, 108, 114, 120, 126, 132, 138, 144, 150, 156, 162, 168, 174 or 180 hours, for example.

The at least two open zones of the coal seam can each be associated with a gasifier and/or well, or other type of channel, borehole, cavity or open formation within or extending adjacent a coal seam.

The linkage channel will typically comprise a multitude of fine cracks/fractures up to about 5 mm in length and width extending between the open zones. Normally, the linkage channel would extend generally horizontally, or at least in some coal seam regions horizontally.

The method is particularly useful for linking two wells together or a well with a cavity of an active or previously active gasifier. The method can be used to connect open zones that are spaced about 10 m, 15 m, 20 m, 25 m, 30 m, 40 m, 50 m or even further distances from one another.

The method can comprise the step of testing the rank and potential permeability (eg. humic acid content) of the coal prior to injecting the pressurized alkali dispersion so as to determine what concentration and quantity of pressurized alkali dispersion is likely to be required.

Particularly preferred embodiments of the invention as claimed herein follow.

According to a first embodiment there is provided a method of permeabilizing a coal seam, said method comprising the step of injecting a pressurized alkali dispersion into the coal seam so as to permeabilize coal of the coal seam.

The pressurized alkali dispersion can comprise alkali dispersed in a pressurized fluid. The pressurized alkali dispersion can comprise at least one type of alkali from Group I of the periodic table of elements. The at least one type of alkali can be sodium, potassium or lithium, or mixtures of two or more of these. The pressurized alkali dispersion can comprise an aqueous solution of alkali hydroxide dispersed in the pressurized fluid. The pressurized alkali dispersion can comprise between about 20% and 30% weight by weight of alkali hydroxide. The pressurized alkali dispersion can comprise NaOH, KOH or LiOH, or mixtures thereof. The pressurized fluid can be pressurized air. The pressurized alkali dispersion can comprise alkali solution particles having an average size between about 10 and 40 microns. The pressurized alkali dispersion can comprise a ratio of approximately 80% volume/volume pressurized fluid to 20% volume/volume alkali solution mist, said mist comprising alkali solution particles having an average size between about 10 and 40 microns.

Permeabilized coal of the coal seam can comprise a multitude of fine cracks/fractures up to about 5 mm in length and width. The coal of the coal seam can be permeabilized up to about 40 m from a point of injection of the pressurized alkali dispersion. The pressurized alkali dispersion can be injected into the coal seam at a rate of about 2-10 $m^3$/min. The pressurized alkali dispersion can be injected into the coal seam at a pressure of between about 10-30 atmospheres. The pressurized alkali dispersion can be injected into the coal seam for at least 1 day, and preferably for about 7 days.

The method can comprise the step of testing the rank and potential permeability of the coal prior to injecting the pressurized alkali dispersion.

According to a second embodiment there is provided a method of permeabilizing a coal seam to connect at least two open zones of a coal seam together with a linkage channel, said method comprising the step of injecting a pressurized alkali dispersion into a first said open zone of the coal seam so as to permeabilize coal of the coal seam and form a linkage channel to at least a second said open zone.

The pressurized alkali dispersion can comprise alkali dispersed in a pressurized fluid. The pressurized alkali dispersion can comprise at least one type of alkali from Group I of the periodic table of elements. The at least one type of alkali can be sodium, potassium or lithium, or mixtures of two or more of these. The pressurized alkali dispersion can comprise an aqueous solution of alkali hydroxide dispersed in the pressurized fluid. The pressurized alkali dispersion can comprise between about 20% and 30% weight by weight of alkali hydroxide. The pressurized alkali dispersion can comprise NaOH, KOH or LiOH, or mixtures thereof. The pressurized fluid can be pressurized air. The pressurized alkali dispersion can comprise alkali solution particles having an average size between about 10 and 40 microns. The pressurized alkali dispersion can comprise a ratio of approximately 80% volume/volume pressurized fluid to 20% volume/volume alkali solution mist, said mist comprising alkali solution particles having an average size between about 10 and 40 microns.

Permeabilized coal of the coal seam can comprise a multitude of fine cracks/fractures up to about 5 mm in length and width extending between the open zones. The method can connect open zones that are spaced up to about 40 m from one another. The pressurized alkali dispersion can be injected into the coal seam at a rate of about 2-10 $m^3$/min. The pressurized alkali dispersion can be injected into the coal seam at a pressure of between about 10-30 atmospheres. The pressurized alkali dispersion can be injected into the coal seam for at least 1 day, and preferably for about 7 days.

The at least two open zones of the coal seam can each be associated with a gasifier and/or well, or other type of channel, borehole, cavity or open formation within or extending adjacent the coal seam. The linkage channel can extend generally horizontally between the open zones. The method can be used for linking two wells together or a well with a cavity of an active or previously active gasifier. The method can comprise the step of testing the rank and potential permeability of the coal prior to injecting the pressurized alkali dispersion.

According to a third embodiment there is provided a pressurized alkali dispersion supply system, said system comprising:

- a source of alkali;
- a source of pressurized fluid;
- a supply pipe having a fluid inlet connected to the source of pressurized fluid, an alkali inlet connected to the source of alkali, and an outlet connectable to a well head for injecting the pressurized alkali dispersion into a coal seam; and
- a fogger associated with the alkali inlet for forming an alkali mist that can mix with pressurized fluid within the supply pipe to form a pressurized alkali dispersion.

The source of pressurized fluid can be an air compressor or a tank of compressed air. The fogger can produce an alkali mist comprising alkali solution particles having an average size between about 10 and 40 microns. The fogger can spray the alkali solution mist at a controlled rate into the supply pipe such that it is at a ratio of approximately 80% volume/volume pressurized fluid to 20% volume/volume mist. The source of alkali can comprise an alkali tank containing alkali solution. The alkali inlet can extend to within the supply pipe from a bottom of the alkali tank, and a control valve of the system associated with the alkali inlet can control the flow rate of alkali solution there through. The alkali tank can have a fluid inlet connected to the supply pipe for receiving compressed fluid so as to place the source of alkali under pressure as well as to ensure proper mixing the alkali tank's contents, and a control valve of the system associated with the alkali tank fluid inlet can regulate the flow of compressed fluid into the alkali tank. The supply pipe can feed pressurized alkali dispersion to the coal seam at a rate of about 2-10 $m^3$/min.

According to a fourth embodiment there is provided a pressurized alkali dispersion supply system, said system comprising:

- a source of pressurized alkali dispersion; and
- a supply pipe having an inlet connected to the source of pressurized alkali dispersion and an outlet connectable to a well head for injecting the pressurized alkali dispersion into a coal seam.

The pressurized alkali dispersion can comprise alkali dispersed in a pressurized fluid. The pressurized alkali dispersion can comprise at least one type of alkali from Group I of the periodic table of elements. The at least one type of alkali can be sodium, potassium or lithium, or mixtures of two or more of these. The pressurized alkali dispersion can comprise an aqueous solution of alkali hydroxide dispersed in the pressurized fluid. The pressurized alkali dispersion can comprise between about 20% and 30% weight by weight of alkali hydroxide. The pressurized alkali dispersion can comprise NaOH, KOH or LiOH, or mixtures thereof. The pressurized fluid can be pressurized air. The pressurized alkali dispersion can comprise alkali solution particles having an average size between about 10 and 40 microns. The pressurized alkali dispersion can comprise a ratio of approximately 80% volume/volume pressurized fluid to 20% volume/volume alkali solution mist, said mist comprising alkali solution particles having an average size between about 10 and 40 microns.

It is to be understood that the systems according to the third and fourth embodiments can be used in the methods according to the first and second embodiments.

Preferred embodiments of the invention will now be described, by way of example, with reference to the accompanying figures.

DESCRIPTION OF EMBODIMENTS

Figure 1:
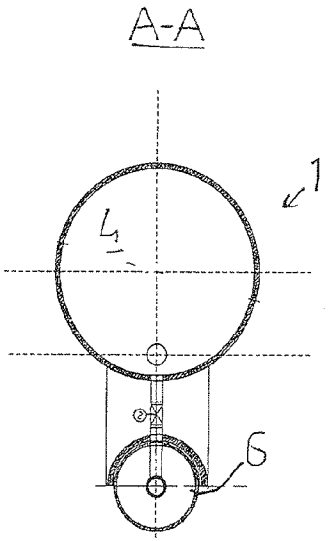
FIG. 1 is an end elevation view of a pressurized alkali dispersion supply system, according to an embodiment of the present invention.

In the figures, like reference numerals refer to like features.

By way of background, the present inventors have discovered that a pressurized alkali dispersion, injected into a coal seam under pressure, can help permeabilize the coal seam and create a linkage channel between two open zones of the coal seam. The initial linkage channel is usually in the form of a multitude of fine cracks/fractures extending between the open zones. Rather than simply acting on existing cracks in the coal, as does pressurized air on its own, the alkali dispersion creates new cracks in the coal. Also, the alkali dispersion penetrates further into the coal seam than pressurized air alone by acting on existing cracks. Hence, there is greater radial coverage and penetration and generation of cracks and hence more chance of successful linkage to other open zones in the seam, particularly over longer distances, than compared with that achievable using pressurized air alone.

Not wishing to be bound by theory, the inventors believe that permeabilization of the coal takes place by way of the alkali dispersion acting on the humic acids that fill intragranular spaces of the coal. Dissolution of humic acids reduces the cohesive forces between grains of coal, thus facilitating the process of crack formation by pressurized air. Humic acids are a group of hydroxy carboxylic acids, formed by the decomposition of dead plants in the form of amorphous materials, forming hydrogen ions and salts, and are capable of base exchange. Lignite, for example, may typically comprise 6-18% weight/weight humic acids.

Referring now to FIGS. 1-4, there is shown a pressurized alkali dispersion supply system 1 for use in permeabilizing a coal seam 2, and in particular for connecting together open zones in a coal seam 2 using a (almost horizontal) linkage channel comprising a multitude of fine cracks. The system 1 includes a source of alkali 4, a source of pressurized air 5 (ie. a fluid), a supply pipe 6 and a fogger 7.

The source of alkali 4 is a cylindrical 170 liter tank 8 containing a solution (20-30% weight by weight sodium hydroxide, although it could also be potassium hydroxide or lithium hydroxide). The tank 8 has an inlet 9 extending to the supply pipe 6 for receiving compressed air so as to place the alkali solution under pressure and to ensure proper mixing of the tank contents. A control valve 10 of the system 1 associated with the inlet 9 regulates the flow of compressed air into the tank 8. The inlet 9 has a plurality of outlets 41 for air positioned along a lower region of the tank 8.

Figure 2:
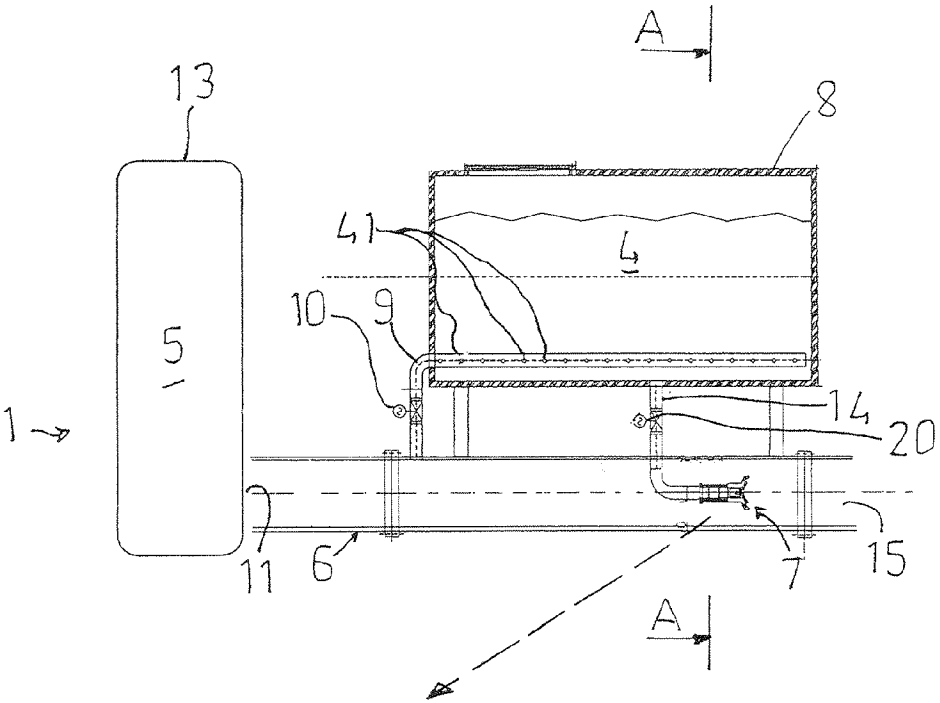
FIG. 2 is a cross sectional view of the supply system shown in FIG. 1 but further showing an air compressor.
Figure 3:
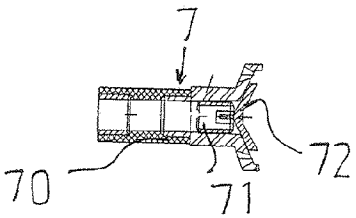
FIG. 3 is an enlarged cross sectional view of a fogger of the supply system shown in FIG. 2.

The source of pressurized air 5 is an air compressor 13 (as shown in FIG. 2).

Figure 4:
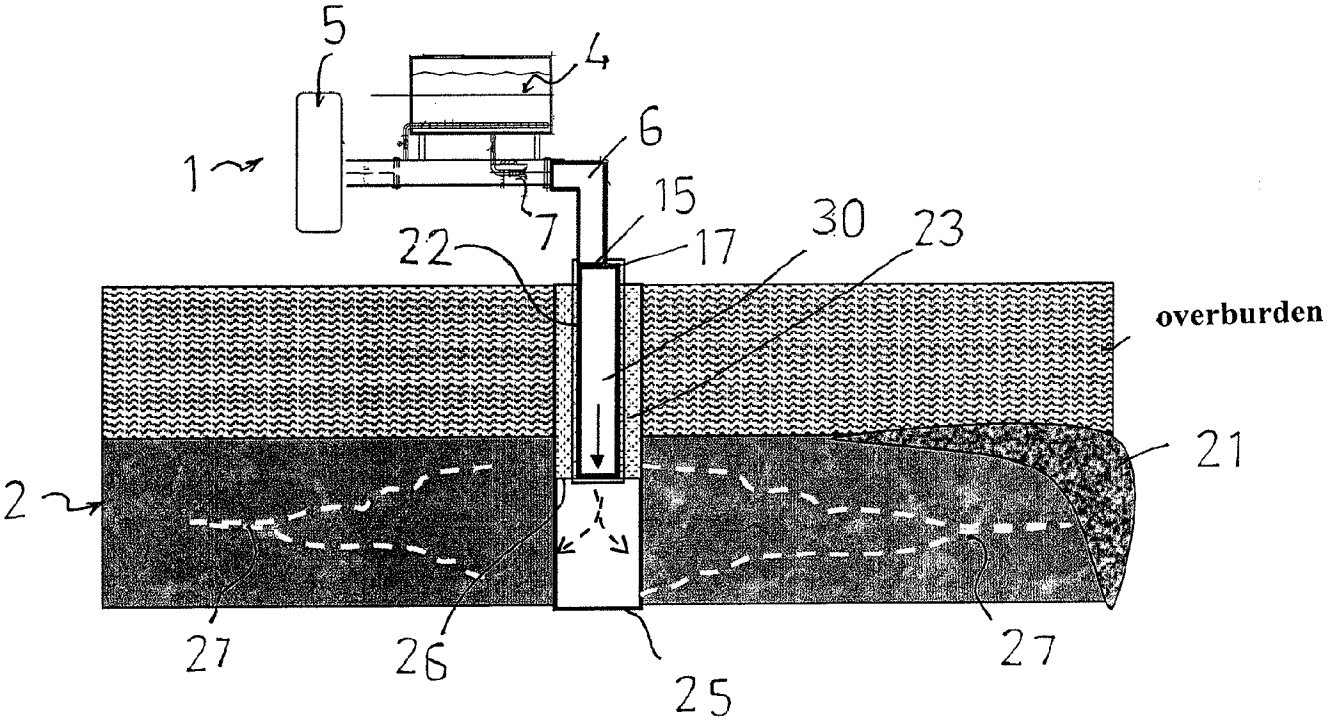
FIG. 4 depicts use of the supply system of FIG. 1 in permeabilizing a coal seam to link a well with a gasifier cavity.

The supply pipe 6 has an inlet 11 connected to the air compressor 13, an inlet pipe 14 extending to the tank 8, and an outlet 15 connectable to a well head 17 for injecting the pressurized alkali dispersion into a coal seam 2. The supply pipe 6 has an inner diameter of about 160 mm. The supply pipe outlet 15 can couple with the well head 17 of a well 30, as depicted in FIG. 4.

The fogger 7 (also known as a sprinkler or mister) is connected to an end of the inlet 14 located within the supply pipe 6. Further details of the fogger 7 can be seen in FIG. 3 (and is a third party commercially available fogger). The fogger 7 has a tubular body 70, channel 71 and head 72. As alkali solution flows through the channel 71 of the body 70 and past the head 72, it is converted into a mist. The fogger 7 converts the pressurized alkali solution into a mist of particles having an average size anywhere between about 10 and 40 microns.

The alkali solution mist mixes with compressed air within the supply pipe 6 at a ratio of approximately 80% volume/volume pressurized air to 20% volume/volume mist. However, this ratio may be varied according to the task at hand. A control valve 20 of the system 1 associated with the inlet 14 regulates the flow of alkali solution to the fogger 7 and can be adjusted to vary the ratio according to the predetermined chemical and physical properties of the coal seam.

The following example explains how the delivery system 1 can be used to permeabilize a coal seam 2 and link a well 30 to a gasifier 21 (gasifier cavity 21) that is in operation.

As seen in FIG. 4, the delivery system 1 is coupled to a well head 17 of a well 30. The well 30 comprises a 128-300 mm metal pipe 22 that is encased in concrete 23.

The coal seam 2 is, for example, located approximately 180-250 m below ground level. The distance from the coal seam floor 25 to a bottom of the well casing 26 is approximately 1.2 m. The coal seam 2 has a humic acid content of between 6-18% weight by weight.

During permeabilization/channel linkage, the supply pipe 6 injects into the coal seam 2 pressurized alkali dispersion at a rate of about 2-10 $m^3$/min and at a pressure of between about 10-30 atmospheres. Permeabilization (cracking/fracturing) of the coal seam 2 is depicted in FIG. 4 in broken lines 27 and the cracking 27 tapers with increasing distance from the well 30.

Figure 5:
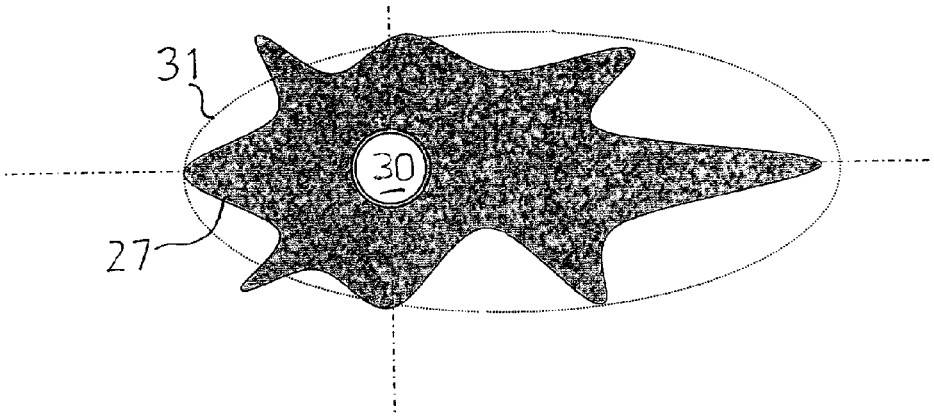
FIG. 5 depicts, in plan, how the coal seam shown in FIG. 4 is permeabilized—showing both theoretical (broken lines) and actual spreading (solid lines) of cracks.

FIG. 5 is a diagram showing theoretical 31 (broken lines) and actual areas 27 (solid lines and shaded) of cracks/fractures 27 opening up in the coal seam 2 (ie. permeabilization) under the influence of compressed air together with dissolution of humic acids by the alkali solution.

Figure 6:
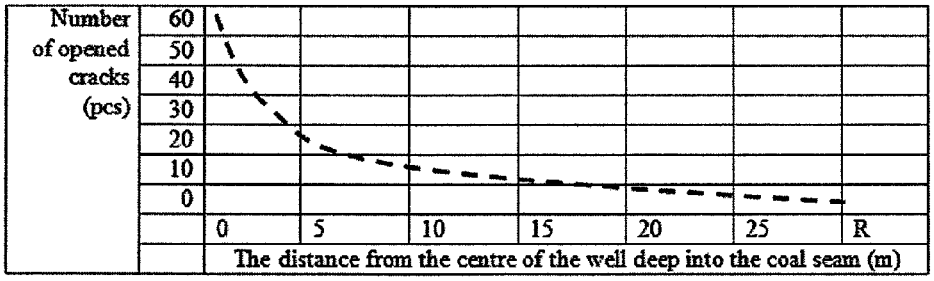
FIG. 6 is a graphical representation of the permeabilization of coal depicted in FIG. 4.

FIG. 6 is a graphical representation of that shown in FIG. 4. The graph shows the number of crack openings/fractures 27 over distance into the coal seam 2. From the centre of the well 30 the magnitude of crack openings is up to 5 mm and the depth of alkali solution penetration into coal is up to 5 mm in each plane of the crack. The graph shows that at the centre of the well 30 there were about 60 cracks in the coal (2 cm apart). At a distance of about 25 m from the well 30 there were about 13 cracks in the coal (2 cm apart).

Table 1 below is a measurement of crack (permeabilization) parameters per unit of time, wherein:

- n—number of cracks in coal spaced 2 cm apart;
- $Q_B$—the volume of compressed air injected through the well into the coal seam is 2-10 $m^3$/min (see Tables 2 and 3);
- $Q_T$—the ratio of filling the cracks in the coal seam with air under 20-30 atm pressure is from 0.01 to 0.05 $m^3$/min; 0.6-3.0 $m^3$/hr, 14.4-72 $m^3$/d, the average value −43 $m^3$/day;
- $q_T$—crack volume;
- L—crack length, taking into account the distance R from the centre of the well;
- R—distance from the well centre;
- S—the area of air infiltration into the coal seam through cracks;
- S of surface—the surface area being treated with an alkali solution;
- T—time;
- $V_{HA}$—the amount of humic acid that is dissolved;
- $V_{HA\ 30\%}$—the necessary permeability of coal to enable creating conditions for the channel burning through;
- $V_S$—the volume of alkali solution required to dissolve the humic acid; and
- $V_{ALK}$—the estimated amount of alkali required for $V_S$, $m^3$/kg.

TABLE 1

| R (m) | 0 | 5 | 10 | 15 | 20 | 25 | 30 |
|---|---|---|---|---|---|---|---|
| n (pcs) | 60 | 25 | 15 | 10 | 8 | 4 | 2 |
| QT ($m^3$) | 43 | 86 | 129 | 172 | 215 | 258 | 301 |
| qT ($m^3$) | 0.72 | 1.72 | 2.87 | 4.30 | 5.38 | 10.75 | 21.50 |
| L (m) | 6.69 | 10.37 | 13.39 | 16.39 | 18.33 | 25.92 | 36.66 |
| S ($m^2$) | 2150 | 2150 | 2150 | 2150 | 2150 | 2150 | 2150 |
| T (day) | 1 | 2 | 3 | 4 | 5 | 6 | 7 |
| S of surface ($m^2$) | 4300 | 4300 | 4300 | 4300 | 4300 | 4300 | 4300 |
| $V_{HA}$ ($m^3$) | 3.44 | 3.44 | 3.44 | 3.44 | 3.44 | 3.44 | 3.44 |
| $V_{HA\ 30\%}$ ($m^3$) | 1.03 | 1.03 | 1.03 | 1.03 | 1.03 | 1.03 | 1.03 |
| Vs ($m^3$) | 0.17 | 0.17 | 0.17 | 0.17 | 0.17 | 0.17 | 0.17 |
| $V_{ALK}$ (kg) | 85 | 85 | 85 | 85 | 85 | 85 | 85 |

Technological parameters of air and alkali solution injection into the supply pipe 6 per minute are given in Table 2 below.

TABLE 2

| | |
|---|---|
| QB ($m^3$/min) | 10 |
| Vs ($m^3$/min) | $1.2*10^{-4}$ |
| Vs (l/min) | 0.12 |
| $V_{ALK}$ (g/min) | 59 |

Technological parameters of air and alkali solution injection into the pipe 6 per hour are given in Table 3 below.

TABLE 3

| | |
|---|---|
| QB ($m^3$/h) | 600 |
| Vs ($m^3$/h) | $7.2*10^{-3}$ |
| Vs (l/h) | 7.2 |
| $V_{ALK}$ (kg/h) | 3.5 |

The data show that pressurized alkali dispersion can be used to effectively permeabilize a coal seam to connect two open zones of a coal seam together with a linkage channel, even though the open zones may be about 25 m apart. After forming the substantially horizontal linkage channel, UCG gasification operations (or other type of burn through) can then be undertaken to establish a wider channel between the open zones.

The invention as exemplified (or as generally described) has at least the following advantages:

1. The invention increases the efficiency of recovering coal (oil shale) by underground gasification method by increasing the distance between the open zones (eg. a gasifier cavity and vertically extending well).
2. The invention reduces energy costs of, and the time for, creating channels between open zones.
3. The invention increases the volume of, coal available for gasification by linkage to a single well.
4. The invention is easy to implement.
5. The invention is several-fold more effective than using compressed air alone for linkage.
6. The invention is non-labor intensive.
7. The invention is an environmentally friendly way of linking as it does not produce hazardous substances in the coal seam.
8. The invention reduces the cost of energy production by increasing the volume of coal gasified out from one production well.

As used herein, except where the context requires otherwise, the term "comprise" and variations of the term, such as "comprising", "comprises" and "comprised", are not intended to exclude further additives, components, integers or steps.

Reference to any prior art in the specification is not, and should not be taken as, an acknowledgment or any form of suggestion that this prior art forms part of the common general knowledge in Australia or any other jurisdiction

The invention claimed is:

1. A pressurized alkali dispersion supply system, said system comprising:

a source of alkali;

a source of pressurized fluid;

a supply pipe having a fluid inlet connected to the source of pressurized fluid, an alkali inlet connected to the source of alkali, and an outlet connectable to a well head for injecting the pressurized alkali dispersion into a coal seam; and a fogger associated with the alkali inlet for forming an alkali mist that can mix with pressurized fluid within the supply pipe to form a pressurized alkali dispersion.

2. The system of claim 1, wherein the source of pressurized fluid is an air compressor or a tank of compressed air.

3. The system of claim 1, wherein the fogger is able to produce an alkali mist comprising alkali solution particles having an average size between about 10 and 40 microns.

4. The system of claim 1, wherein the fogger sprays the alkali solution mist at a controlled rate into the supply pipe such that it is at a ratio of approximately 80% volume/volume pressurized fluid to 20% volume/volume mist.

5. The system of claim 1, wherein the source of alkali comprises an alkali tank containing alkali solution.

6. The system of claim 5, wherein the alkali inlet extends to within the supply pipe from a bottom of the alkali tank, and a control valve of the system associated with the alkali inlet controls the flow rate of alkali solution there through.

7. The system of claim 6, wherein the alkali tank has a fluid inlet connected to the supply pipe for receiving compressed fluid so as to place the source of alkali under pressure as well as to ensure proper mixing of the alkali tank's contents, and a control valve of the system associated with the alkali tank fluid inlet regulates the flow of compressed fluid into the alkali tank.

8. The system of claim 1, wherein the supply pipe is capable of feeding pressurized alkali dispersion to the coal seam at a rate of about 2-10 $m^3$/min.

9. The system of claim 1, wherein the fogger is disposed in the supply pipe.

10. The system of claim 9, wherein the fogger extends coaxially through the supply pipe downstream of the location where the pressurized fluid flows into the supply pipe from the source of pressurized fluid such that the fogger is within a flow path of the pressurized fluid flowing from the source of pressurized fluid.

11. The system of claim 1, wherein the fogger injects alkali into the supply pipe downstream of the location where the pressurized fluid flows into the supply pipe from the source of pressurized fluid.

12. The system of claim 1, wherein the source of alkali comprises a fluid inlet connected to the supply pipe for receiving pressurized fluid.

* * * * *